US007727097B2

(12) United States Patent
Siegel et al.

(10) Patent No.: US 7,727,097 B2
(45) Date of Patent: Jun. 1, 2010

(54) SPORT NOVELTY MISSILE

(76) Inventors: Michael L. Siegel, 1 Hobbs Dr., Blauvelt, NY (US) 10913; Paul Schefflein, 14 Habitat La., Cortlandt Manor, NY (US) 10567; Michael G. D'Agostino, 58 Yorkshire Ter., Washingtonville, NY (US) 10992

( * ) Notice: Subject to any disclaimer, the term of this patent is extended or adjusted under 35 U.S.C. 154(b) by 165 days.

(21) Appl. No.: 11/890,622

(22) Filed: Aug. 8, 2007

(65) Prior Publication Data

US 2009/0042677 A1 Feb. 12, 2009

(51) Int. Cl.
*A63B 43/00* (2006.01)

(52) U.S. Cl. ..... 473/577; 473/570; 446/24

(58) Field of Classification Search ..... 473/594, 473/570, 571, 595, 577, 613, 351–354; 102/334; 362/379; 441/19; 472/51–56; 446/24, 25
See application file for complete search history.

(56) References Cited

U.S. PATENT DOCUMENTS 1,583,721 A * 5/1926 Kane ..... 473/353
1,664,397 A * 4/1928 Bens ..... 473/353
2,324,359 A * 7/1943 Callan ..... 446/24
2,409,471 A * 10/1946 Brosseit ..... 446/24
2,608,025 A * 8/1952 Miller ..... 446/24
3,150,875 A * 9/1964 Searles ..... 473/577
3,233,544 A * 2/1966 Hosoya ..... 473/353
3,234,357 A * 2/1966 Seuthe ..... 392/403
3,964,304 A 6/1976 Parrish
4,303,397 A 12/1981 Swiatosz
4,326,119 A * 4/1982 Swiatosz ..... 392/397
4,493,211 A 1/1985 Weinstein
4,564,199 A * 1/1986 Adams ..... 473/354
4,614,340 A * 9/1986 Hosoya ..... 473/353
4,697,807 A * 10/1987 Boundy ..... 473/369
4,818,843 A * 4/1989 Swiatosz ..... 392/397
4,830,370 A * 5/1989 Schlesinger ..... 473/577
5,069,230 A * 12/1991 Green ..... 446/24
5,112,055 A * 5/1992 Barnhill ..... 473/353

(Continued)

FOREIGN PATENT DOCUMENTS

JP 06327795 A * 11/1994

(Continued)

*Primary Examiner*—Steven Wong
(74) *Attorney, Agent, or Firm*—Joseph L. Spiegel; Heslin Rothenbeg Farley & Mesiti P.C.

(57) ABSTRACT

A sport novelty ball has an outer shell and a stabilizing shock absorbing core in which various interior components are embedded. A non-toxic smoke solution is introduced into the ball and stored. Centrally located within the ball is a smoke chamber containing a heating element, A switch/pump assembly is provided for completing an electrical circuit and moving the smoke solution through the ball. Upon actuation of the switch/pump assembly, simultaneously the heating element is actuated and the solution is pressured through fluid lines in the ball to an atomizer for spraying the solution onto the heating element, whereupon smoke is generated in the smoke chamber. Exhaust/intake channels extend from the smoke chamber to the ball periphery. When the ball is thrown, ambient air passing through the exhaust/intake channels causes a stream of air to be emitted from the channels, giving the appearance that the ball is smoking. A motion activated sound chip produces a sound feature which adds the impression of throwing a super fast pitch.

7 Claims, 1 Drawing Sheet

U.S. PATENT DOCUMENTS

| | | | | |
|---|---|---|---|---|
| 5,236,383 | A * | 8/1993 | Connelly | 473/570 |
| 6,048,250 | A * | 4/2000 | Hudson | 473/578 |
| 6,189,453 | B1 * | 2/2001 | Lin | 102/334 |
| 6,280,278 | B1 * | 8/2001 | Wells | 446/25 |
| 6,421,502 | B1 | 7/2002 | Aronie | |
| 6,601,776 | B1 * | 8/2003 | Oljaca et al. | 239/5 |
| 6,826,355 | B2 * | 11/2004 | Aronie et al. | 392/399 |
| 7,086,920 | B2 | 8/2006 | Fusco | |
| 2005/0003731 | A1 | 1/2005 | LaFata | |
| 2006/0116048 | A1 | 6/2006 | Choi | |

FOREIGN PATENT DOCUMENTS

| | | | |
|---|---|---|---|
| JP | 09028835 | A * | 2/1997 |
| JP | 2000140161 | A * | 5/2000 |
| JP | 2003062124 | A * | 3/2003 |
| JP | 2005335998 | A * | 12/2005 |

* cited by examiner

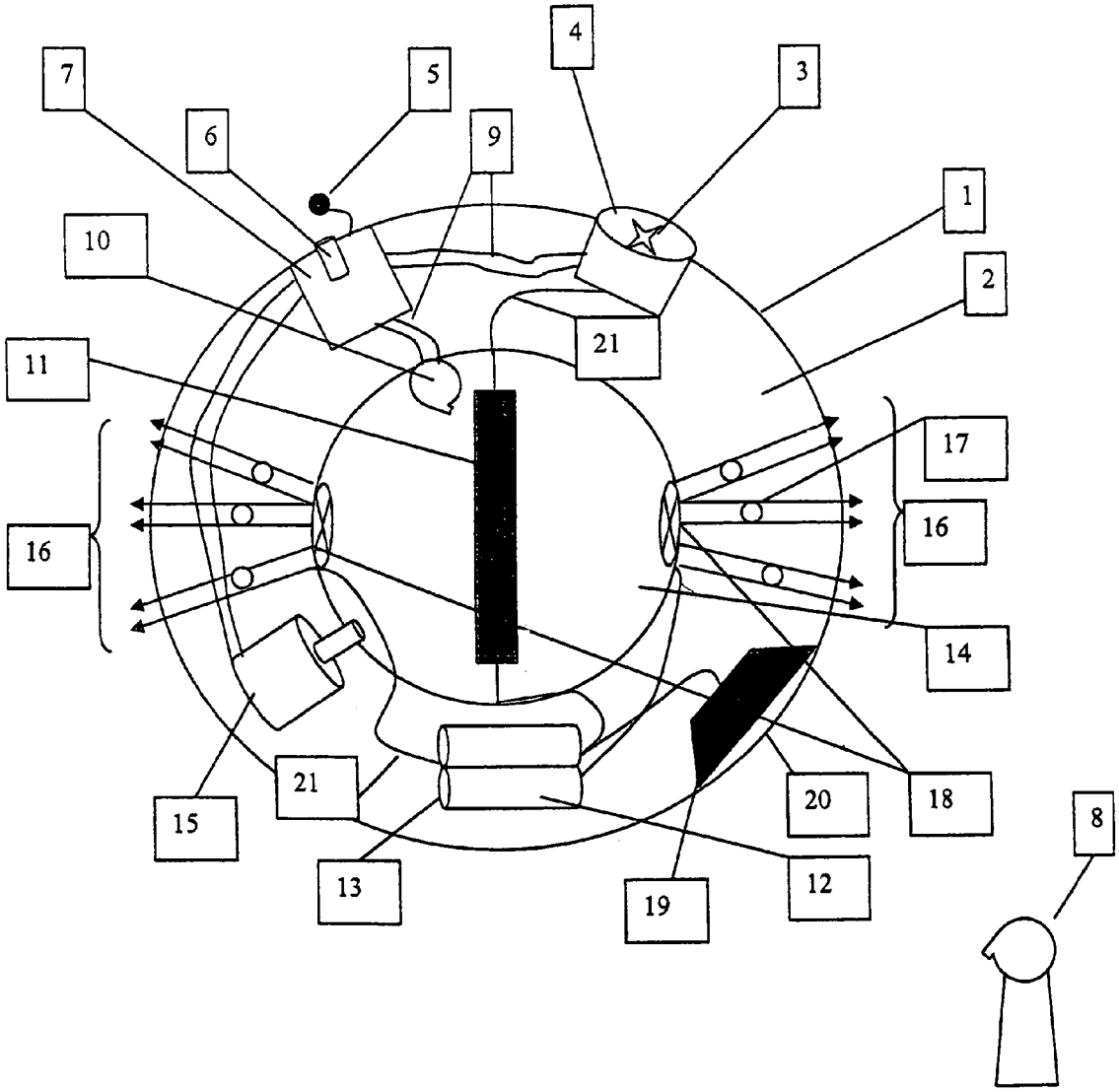
4
7
5
3
6
9
1
10
2
21
11
17
16
16
14
21
20
18
8
15
13
19
12

SPORT NOVELTY MISSILE

BACKGROUND OF THE INVENTION

1. Field of the Invention

Sports have long captured the interest of adults and children. The use of novelty items so as to replicate sports heroes who perform at the highest level, such as professional baseball players, is a way of increasing and enhancing an individual's enjoyment of the sport.

The present invention is in the nature of a novelty item, and, in particular, to a ball that appears to generate smoke and give off sound when thrown to provide the experience of throwing or catching a super-fast ball or other type missile.

2. Description of the Prior Art

Various mechanisms and devices exist that create smoke, vapor or some variation thereof as their primary function. These mechanisms and devices may be stationary or portable, for commercial or recreational use, for indoor and/or outdoor activities (some undesirable for health, clean-up or handling reasons), but none for novelty purposes envisioned by this invention, with the possible exception of Hosoya, U.S. Pat. No. 4,614,340. Hosoya describes a ball that has a central core of detonator material and a layer of smoke emitting material to be ignited by the detonator material, but only upon percussive contact between bat and ball and not just when thrown.

SUMMARY

An object of the invention is the provision of a sport novelty ball that increases and enhances an individual's enjoyment of the sport.

Another object is the provision of a sport novelty ball that appears to generate smoke and give off sound when thrown.

These and other objects, features and advantages are accomplished in accordance with the teachings of the present invention, one illustrative embodiment of which comprises a sport novelty ball having an outer shell and a stabilizing shock absorbing core in which various interior components are embedded. A non-toxic smoke solution is introduced into the ball and stored. Centrally located within the ball is a smoke chamber containing a heating element, A switch/pump assembly is provided for completing an electrical circuit and moving the smoke solution through the ball. Upon actuation of the switch/pump assembly, simultaneously the heating element is actuated and the solution is pressured through fluid lines in the ball to an atomizer for spraying the solution onto the heating element, whereupon smoke is generated in the smoke chamber. Dual functioning exhaust/intake channels extend from the smoke chamber to the ball periphery. When the ball is thrown, ambient air passing through the exhaust/intake channels causes a stream of air to be emitted from the channels, giving the appearance that the ball is smoking. A motion activated sound chip produces a sound feature that adds the impression of throwing a super fast pitch.

BRIEF DESCRIPTION OF THE DRAWING

Other objects, features and advantages of the present invention will be apparent from the following detailed description and accompany drawing, wherein:

FIG. 1 is a schematic diagram of the present invention.

DETAILED DESCRIPTION

Referring now to the diagram, the ball of the present invention is seen as including an outer shell or skin 1. Skin 1 may be made of available synthetic materials that resemble the leather of an official baseball and can include painted-on stitching.

The ball includes a stabilizing shock absorbing core 2 of a latex based material in which the various interior components to be described hereafter are embedded. The core 2 also protects the ball from degradation.

At the periphery of the ball is an indicator light 3 that, when lit, indicates that the ball has been activated for use.

Also flush with the ball's periphery is a switch/pump assembly 4 that will complete an electrical circuit and move fluid in lines through the ball.

The periphery of the ball further includes a permanently attached solution-filling cap 5 and uni-directional solution-filling port 6. Cap 5 will be removed and a non-toxic smoke solution from an external source 8 will be introduced into a primary solution tank 7 via the port 6. The solution may be made of propylene glycol, glycerin and distilled water.

The numeral 9 is used to designate solution lines, one of them leading from the pump assembly 4, to an atomizer 10 and to a secondary solution tank to be described hereafter.

Disposed within the interior of the ball is a heating element 11 such as one using an electrical resistance heating wire. When activated and when solution is sprayed onto the element 11 by the atomizer 10, smoke is generated.

Batteries 12, housed within a battery pack 13 are connected by wiring for electrical activation of various components within the ball such as the heating element 11, light 3, and fans and sound chip to be described hereafter. The total voltage is on the order of 6-9 volts.

Centrally located within the ball is a smoke chamber 14 that initially encloses the smoke that is generated when the heating element 11 contained therein is sprayed with solution by the atomizer 10.

The ball may be provided with a secondary solution tank 15. In the event the atomizer 10 is over-actuated, as by too much pumping of the switch/pump assembly 4,tank 15 becomes a receptacle for surplus solution.

Exhaust/intake channels 16 extend from the smoke chamber 14 to the periphery of the ball. Preferably, the channels 16 terminate at the periphery of the ball where painted-on stitching is located. Up to four channels can be positioned on opposite sides of the ball.

The channels 16 are provided with shutters 17 free to rotate 360 degrees when activated by ambient air passing through the channels 16. Optionally, motion sensitive fans 18 push smoke out of the smoke chamber 14 when the ball is in flight.

Finally the ball is provided at its periphery with a motion-activated sound chip 19 that is activated upon launching or tossing of the ball, and sound grill 20 that permits sound to escape from the ball. Sound chips that produce sound effects when an object is set in motion are well known in the art.

The wiring for the various electrical components within the ball is indicated generally by the numeral 21.

The various components are placed to evenly distribute weight, providing the ball with adequate balance for play and held in place by molded plastics and the stabilizing shock absorbing core 2.

In use, the user removes cap 5 and loads solution from the external source 8 via port 6 into the primary tank 7. The unidirectional attribute of the port 6 prevents solution from leaking back onto the skin 1. The tank 7 holds solution in preparation for use.

The switch/pump assembly 4 is then pressed. Pressing the switch/pump assembly 4 has a three-fold function. It completes an electrical circuit to activate the heating element 11 and turn the indicator light 3 on. Thirdly, it creates a pressurized system among the primary solution tank 7, the secondary overflow solution tank 15, the lines 9 and the atomizer 10. Solution is forced through the atomizer onto the heating element 11 contained within smoke chamber 14.

Within the chamber 14, solution is transformed into smoke via super heating. By super heating is merely meant that the solution is heated enough to convert it into a gas thus emitting what appears to be smoke. Smoke builds up within the smoke chamber 14, until the ball is put in motion with velocity so that ambient air passing through the exhaust/intake channels 16 activates the shutters 17. Fans 18, that are optional, and would be activated by the switch/pump assembly 4, may assist in projecting the smoke. Excess solution that is not converted to smoke drains into overflow tank 15 and is pumped back into primary tank 7 upon the next activation of the ball.

This process promotes a high level of system efficiency, utilizing as much solution as possible and preventing of loss through recycling of unused solution, at the same time preventing flooding of the heating element 11.

Upon projection of the ball, a stream of smoke emits from the exhaust/intake channels 16, giving the appearance that the ball is smoking.

Projection of the ball also activates the sound chip 19, the sound of which adds the impression of throwing a super fast pitch.

The ball withstands the trauma of being thrown and caught and maintains the mechanical inner-workings because of its stabilizing core of shock-absorbing material.

The present invention combines the timelessness of a baseball with smoke generating and sound effects that create the feeling of throwing the ultimate fastball. Thus, when the ball is primed and tossed or thrown it leaves a visible trail of smoke behind, along with an appropriate sound effect bringing to life the classic phrase "throwing the heater".

The user will watch as a trail of smoke specifically marks the path of flight of his/her fastball right into the catcher's mitt. The visual effect of this ultimate fastball will be accompanied by an appropriate sound effect to enhance the user's overall sports fantasy experience. It will provide hours of enjoyment to those wishing they could throw like a real bigleaguer.

The smoke emitted is non-toxic and non-staining, made of common ingredients found in other toys. It will not harm the leather of a baseball or softball glove and will not leak due to the fully integrated and highly efficient uni-body design of the solution housing system.

While the invention has been described with a baseball in mind, the technology disclosed herein and application thereof has the potential to improve the experience of imaginative sports play regardless of the projectile, whether it be a sphere, spheroid, orb, globe or ovaloid used in the performance of sport. It can also be used with other projectiles such as frisbees, footballs, boomerangs, soccer balls and other missiles that can be launched.

It should be obvious that changes, additions and omissions may be made in the details and arrangement of parts without departing from the spirit and scope of the invention as hereinafter claimed.

What is claimed is:

1. A sport novelty missile that appears to generate smoke when thrown, comprising:

a body having an outer shell;

a smoke solution;

a holding tank within the body for receiving and holding the solution;

a smoke chamber within the body;

an electrical power source;

an atomizer;

fluid lines for conveying solution from the holding tank to the atomizer; an electrically actuable assembly for pressuring flow of solution from the holding tank to the atomizer, the actuation of the electrically actuable assembly completing an electrical circuit between the power source and heating element to activate the heating element, and pressuring the flow of solution from the holding tank through the fluid lines to the atomizer, the atomizer so positioned as to spray solution onto the heating element and thereby generate smoke within the smoke chamber;

dual functioning channels extending through die body from the smoke chamber through the outer shell;

whereby, upon throwing the missile, ambient air passing into and through the dual functioning channels causes smoke to be emitted from the smoke chamber through the dual functioning channels and outer shell; and, a stabilizing shock absorbing core disposed within the body.

2. The missile of claim 1 including a motion activated sound chip connected to the electrical power source for producing a sound feature when the missile is thrown.

3. The missile of claim 1 including a light connected to the electrical power source and electrically actuable assembly that is lit upon actuation of the electrically actuable assembly.

4. The missile of claim 1 including a capped filling port for introducing smoke solution into the holding tank.

5. The missile of claim 1 including a secondary tank in fluid communication with the holding tank via fluid lines and the smoke chamber for receiving and returning excess solution from the smoke chamber to the holding tank.

6. The missile of claim 1 including motion sensitive fans disposed within the dual functioning channels.

7. The missile of claim 1 including motion sensitive fans connected to the electrical power source that are activated when the missile is thrown.

* * * * *